US012428935B2

(12) United States Patent
Pedersen

(10) Patent No.: US 12,428,935 B2
(45) Date of Patent: Sep. 30, 2025

(54) METHOD FOR CONNECTING A SUBSEA WELL TO A SUBSEA PIPELINE

(71) Applicant: AKER SOLUTIONS SUBSEA AS, Lysaker (NO)

(72) Inventor: Martin Pedersen, Oslo (NO)

(73) Assignee: ONESUBSEA AS, Lysaker (NO)

( * ) Notice: Subject to any disclaimer, the term of this patent is extended or adjusted under 35 U.S.C. 154(b) by 0 days.

(21) Appl. No.: 18/728,461

(22) PCT Filed: Jan. 16, 2023

(86) PCT No.: PCT/NO2023/050008

§ 371 (c)(1),
(2) Date: Jul. 12, 2024

(87) PCT Pub. No.: WO2023/136732

PCT Pub. Date: Jul. 20, 2023

(65) Prior Publication Data

US 2025/0154855 A1 May 15, 2025

(30) Foreign Application Priority Data

Jan. 14, 2022 (GB) ..... 2200434

(51) Int. Cl.
*E21B 19/00* (2006.01)
*E21B 33/038* (2006.01)
(Continued)

(52) U.S. Cl.
CPC ..... *E21B 43/0107* (2013.01); *E21B 19/002* (2013.01); *E21B 33/038* (2013.01); *E21B 43/017* (2013.01)

(58) Field of Classification Search
CPC .. E21B 19/002; E21B 33/038; E21B 43/0107; E21B 43/013; E21B 43/017
See application file for complete search history.

(56) References Cited

U.S. PATENT DOCUMENTS 3,934,647 A 1/1976 Bokenkamp
4,194,857 A 3/1980 Chateau et al.
(Continued)

FOREIGN PATENT DOCUMENTS

GB 2 059 534 A 4/1981
GB 2 296 957 A 7/1996
(Continued)

*Primary Examiner* — Matthew R Buck
(74) *Attorney, Agent, or Firm* — Jeffrey D. Frantz

(57) ABSTRACT

A method for connecting a subsea well to a subsea pipeline. The method includes providing a subsea pipeline with a connection station. The connection station has a connector for connecting a fluid conduit to the connector, and a fluid port in a fluid communication with an interior of the subsea pipeline. The method further includes drilling a borehole adjacent to the connection station, locating a wellhead support adjacent to the connection station, connecting the wellhead support to the subsea pipeline, mounting a wellhead on the wellhead support, aligning the wellhead with the borehole to establish a subsea well, mounting a connection module on the wellhead support or on the wellhead, and fluidly connecting the subsea well to the fluid port in the connection station via the connection module.

21 Claims, 5 Drawing Sheets

(51) Int. Cl.
*E21B 43/01* (2006.01)
*E21B 43/017* (2006.01)

(56) References Cited

U.S. PATENT DOCUMENTS

| | | | | | |
|---|---|---|---|---|---|
| 5,722,796 | A * | 3/1998 | Halvorsen | E21B 41/08 166/341 |
| 11,053,746 | B2 | 7/2021 | Rageot et al. | |
| 11,352,857 | B2 * | 6/2022 | Stokke | E21B 43/017 |
| 11,982,161 | B2 * | 5/2024 | Donald | E21B 41/0007 |
| 2019/0277116 | A1 * | 9/2019 | Halvorsen | E21B 43/00 |
| 2019/0323325 | A1 * | 10/2019 | Hestetun | E21B 41/08 |
| 2019/0360313 | A1 * | 11/2019 | Ellingsen | E21B 33/035 |
| 2020/0088320 | A1 * | 3/2020 | De Lemos Junior | F16L 1/26 |
| 2020/0318759 | A1 * | 10/2020 | Ilstad | F16L 1/26 |
| 2020/0392817 | A1 * | 12/2020 | Correc | E21B 43/017 |
| 2021/0079763 | A1 * | 3/2021 | Ali | F16L 1/16 |
| 2021/0189841 | A1 * | 6/2021 | Rasmussen | E21B 43/017 |
| 2022/0307350 | A1 | 9/2022 | Hestetun | |

FOREIGN PATENT DOCUMENTS

| | | | | |
|---|---|---|---|---|
| GB | 2 429 990 | A | 3/2007 | |
| NO | 315721 | B1 * | 10/2003 | |
| WO | WO-2004085789 | A2 * | 10/2004 | E21B 41/08 |
| WO | WO 2021/001056 | A1 | 1/2021 | |
| WO | WO-2023083959 | A1 * | 5/2023 | |

* cited by examiner

METHOD FOR CONNECTING A SUBSEA WELL TO A SUBSEA PIPELINE

CROSS-REFERENCE TO RELATED APPLICATIONS

This application is a National Stage Entry of International Patent Application No. PCT/NO2023/050008, filed on Jan. 16, 2023, which claims priority to Norwegian Patent Application No. 2200434.5, filed on Jan. 14, 2022.

FIELD

The present disclosure relates to a method for connecting a subsea well to a subsea pipeline and to a manifold arrangement for connecting a subsea well to a subsea pipeline.

BACKGROUND

Manifolds are used in subsea oil and gas production for comingling and/or distribution of flow between one main bore and one or more branches/flow paths, such as pipelines or fluid conduits. For example, a manifold may be used when comingling the flow of several hydrocarbon production wells into one common pipeline, or when distributing injection medium from one pipeline into several wells and/or or other locations throughout a system of pipework. In some existing examples, a number of subsea wells (e.g., production or injection wells) may be connected to a single manifold. This may require the connection of the subsea wells together, for example, by daisy-chaining the wells together, and the pipelines connecting the wells may require to be laid in several stages after the wells have been drilled and installed. This process may be both time consuming and expensive, and may leave little room for adaptation after the wells and connecting pipelines have been installed.

In systems such as subsea pipework systems, the main bore is typically referred to as the "header". The header can include, for example, a system for the connection of pipelines at one or both ends, and may be an integral part of the pipeline. The header may also include one or more valves for controlling a flow of fluid therethrough.

The connection of several manifolds to a single pipeline is common. As such, a header may be designed (e.g., dimensioned) to account for more flow than the branches/flow paths in one specific manifold alone may account for. In traditional manifold design, there may exist tie-in points for several branches, all aligned in the same direction, going back to a header (e.g., a horizontally oriented header). This design may mean that each of the branches are unique, and/or that each of the branches must be tailored to the requirements of each specific manifold. This may therefore increase the cost involved and may make standardization difficult. In other designs, there may exist a header pipe with either one or a number of inline tees positioned therealong, and to which it is possible to connect at least one subsea well via a conduit such as a well jumper. However, for this to work, the subsea distance between the subsea well and the inline tee to which the well is to be connected must be measured, and the jumper fabricated to match the measured distance. There is also a risk of leakage at least at the connection point between the subsea well and the jumper.

SUMMARY

An aspect of the present invention is to mitigate, alleviate or eliminate one or more of the above-identified deficiencies and disadvantages in the prior art and to solve at least the above-mentioned problem.

In an embodiment, the present invention provides a method for connecting a subsea well to a subsea pipeline. The method includes providing a subsea pipeline comprising at least one connection station. The at least one connection station comprises a connector for connecting a fluid conduit to the connector, and at least one fluid port in a fluid communication with an interior of the subsea pipeline. The method further comprises drilling a borehole adjacent to the at least one connection station, locating a wellhead support adjacent to the at least one connection station, connecting the wellhead support to the subsea pipeline, mounting a wellhead on the wellhead support, aligning the wellhead with the borehole to establish a subsea well, mounting a connection module on the wellhead support or on the wellhead, and fluidly connecting the subsea well to the at least one fluid port in the at least one connection station via the connection module.

BRIEF DESCRIPTION OF THE DRAWINGS

The present invention is described in greater detail below on the basis of embodiments and of the drawings in which.

DETAILED DESCRIPTION

Figure 1:
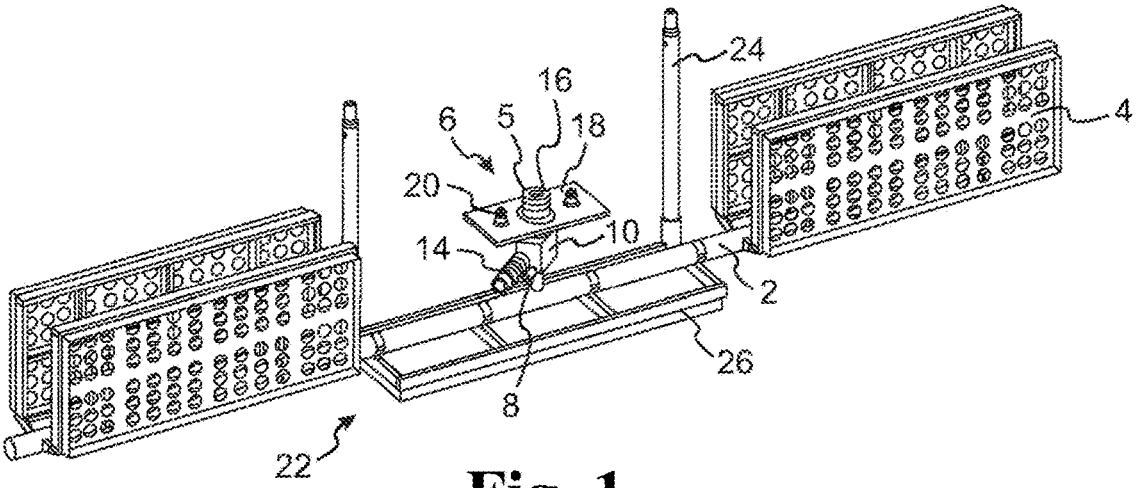
FIG. 1 shows a perspective view of an example of a subsea pipeline and guiding arrangement in a subsea location.

A first aspect of the present invention provides a method for connecting a subsea well to a subsea pipeline, comprising: providing a subsea pipeline comprising at least one connection station, the connection station comprising a connector for connecting a fluid conduit thereto, and at least one fluid port in fluid communication with an interior of the subsea pipeline; drilling a borehole adjacent the connection station; locating a wellhead support adjacent the connection station and connecting the wellhead support to the subsea pipeline, mounting a wellhead on the wellhead support, and aligning the wellhead with the drilled borehole to establish a subsea well; mounting a connection module on the wellhead support or the wellhead; fluidly connecting the subsea well to the at least one fluid port in the connection station via the connection module.

The method may further comprise:

locating a drilling guide adjacent the connection station;

guiding a drilling tool to a subsea well target location via the drilling guide; and drilling the borehole at the subsea well target location using the guided drilling tool.

The method may further comprise locating a conductor pipe in the borehole, and positioning the conductor pipe within a guide sleeve of the wellhead support prior to mounting the wellhead on the wellhead support.

The method may further comprise connecting a guiding arrangement to the subsea pipeline, the guiding arrangement forming part of the connection station.

The method may further comprise locating a first vertically extending guide member of the guiding arrangement on one side of the connection station, and locating a second vertically extending guide member of the guiding arrangement on an opposite side of the connection station, the section of subsea pipeline located between the first and second guide members forming part of the connection station.

The method may further comprise guiding the wellhead support to a location adjacent the subsea pipeline via the guiding arrangement.

The method may further comprise guiding a drilling guide to a location adjacent the subsea pipeline via the guiding arrangement.

The method may further comprise mounting the wellhead support on the connection station so as to position the wellhead laterally offset from the subsea pipeline.

The method may further comprise drilling the borehole through a through-bore in the drilling guide, the through-bore being laterally offset from the longitudinal axis of the subsea pipeline.

The method may further comprise drilling the borehole through a guide sleeve in the wellhead support.

The connection station may comprise a valve for controlling fluid flow between the subsea pipeline and the at least one fluid port, and the method may further comprise operating the valve in the at least one connection station to configure the valve between a closed position in which fluid flow between the subsea pipeline and the fluid port is restricted, and an open position in which fluid flow to the connection module via the fluid port is permitted.

The method may further comprise flowing a fluid in the subsea pipeline with the valve for controlling flow through the at least one fluid port in the closed position prior to the step of fluidly connecting the connection module to the at least one fluid port.

The method may further comprise locating a pipeline support under a portion of the subsea pipeline adjacent the connection station.

The method may further comprise directly connecting the connection module to the least one fluid port of the connection station via the connector.

The connection module may comprise a manifold structure.

The connection module may comprise a subsea Christmas tree.

The subsea pipeline may comprise a plurality of connection stations located thereon, and the method may further comprise:

drilling a borehole adjacent each of the plurality of connection stations;

locating a wellhead support adjacent at least two of the plurality of connection stations and connecting each wellhead support to the subsea pipeline, mounting a wellhead on each wellhead support, and aligning each wellhead with each respective borehole to provide a subsea well at each of the boreholes;

mounting a connection module on each wellhead support; and fluidly connecting each subsea well to the at least one fluid port in each respective connection station via the respective connection module.

A second aspect of the present invention provides a method for establishing a cluster of subsea wells, the method comprising establishing a first subsea well, on a sea floor, a pipeline fluidly connected to the first well, the pipeline comprising at least one connection station, the connection station comprising a connector for connecting a fluid conduit thereto, and at least one fluid port in fluid communication with an interior of the subsea pipeline; and establishing a second subsea well and fluidly connecting the second subsea well to the pipeline via the connection station.

The method may further comprises flowing a fluid to and/or from the first subsea well via the pipeline prior to establishing a second subsea well and/or while establishing the second subsea well.

The connection station has a cap or cover, and the method may comprise removing the cap or cover from the connection station prior to connecting the second subsea well to the connection station.

The time between installing the pipeline on the sea floor and establishing a second subsea well may be more than one year, more than two years, or more than three years.

The step of establishing the second subsea well and fluidly connecting the second subsea well to the subsea pipeline comprises using the method according to the first aspect.

The step of establishing of a second subsea well may be carried out after installation of the subsea pipeline.

The second subsea well may be established adjacent the connection station.

A third aspect of the present invention provides a subsea pipeline system comprising a pipeline having a first end and a second end and comprising at least one connection station which is located between the first end and the second end, the connection station having a connector for connection of a subsea well thereto in order to connect the subsea well with an interior of the subsea pipeline.

The connection station may be provided with a guiding arrangement which is connected to the pipeline and configured for receiving and guiding a wellhead support in place adjacent the connection station and the pipeline.

The guiding arrangement may comprise a guide base and a plurality of guide members.

The guiding arrangement may comprise a first vertically extending guide member and a second vertically extending guide member, the first vertically extending guide member being longitudinally offset from the second vertically extending guide member along the subsea pipeline.

The first guide member may be located on a first side of a fluid port of the connection station and the second guide member located on a second side of the fluid port, the first side being longitudinally opposite the first side.

The subsea pipeline system may further comprise a wellhead support which is mounted on the guiding arrangement.

The wellhead support may comprise a plurality of elongate vertically extending secondary guide members.

The subsea pipeline system may further comprise a pipeline support for supporting the pipeline on the sea floor and maintaining a desired orientation of the pipeline.

The at least one connection station is capped or covered by a removable cap or cover.

The subsea pipeline system may further comprise a drilling guide which is connected to the pipeline and which is configured to provide a guide and/or position a drilling tool at a target location adjacent to the connection station for drilling a subsea borehole or well.

A fourth aspect of the present invention provides a subsea well system comprising a subsea pipeline comprising at least one connection station, the connection station comprising a connector for connecting a fluid conduit thereto and at least one fluid port in fluid communication with an interior of the subsea pipeline, the system further comprising a drilled borehole adjacent the connection station, a wellhead support adjacent the connection station and connected to the subsea pipeline, a wellhead mounted on the wellhead support and aligned with the drilled borehole, a connection module mounted on the wellhead support or the wellhead which fluidly connects the subsea well to the at least one fluid port in the connection station.

The connection station may comprise a valve for controlling fluid flow between the subsea pipeline and the at least one fluid port, the valve being movable between a closed position in which fluid flow between the subsea pipeline and the fluid port is restricted, and an open position in which fluid flow to the connection module via the fluid port is permitted.

The system may further comprise a pipeline support located under a portion of the subsea pipeline adjacent to the connection station.

The connection module may be connected directly to the least one fluid port of the connection station via the connector.

The connection module may be supported by the wellhead support or the wellhead support and the pipeline support where provided.

The connection module may comprise a manifold structure.

The connection module may comprise a subsea Christmas tree.

The present disclosure will become apparent from the detailed description given below. The detailed description and specific examples disclose example embodiments of the disclosure by way of illustration only. Those skilled in the art understand from guidance in the detailed description that changes and modifications may be made within the scope of the disclosure.

Hence, it is to be understood that the herein disclosed disclosure is not limited to the particular component parts of the device described or steps of the methods described since such device and method may vary. It is also to be understood that the terminology used herein is for purpose of describing particular embodiments only, and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, the words "comprising", "including", "containing" and similar wordings does not exclude other elements or steps.

The present description provides an improved method for connecting subsea well to subsea pipeline and manifold arrangement for connecting subsea well to subsea pipeline. According to an example embodiment there is provided a method for connecting a subsea well to a subsea pipeline, comprising: providing a subsea pipeline comprising at least one connection station, the connection station comprising a connector for connecting a fluid conduit thereto, and at least one fluid port in fluid communication with an interior of the subsea pipeline; drilling a subsea well adjacent the connection station; locating a wellhead support adjacent the connection station, the wellhead support comprising a wellhead, and aligning the wellhead with the drilled subsea well; mounting a manifold structure on the wellhead support; fluidly connecting the manifold structure to the at least one fluid port in the connection station via a fluid conduit, the fluid conduit being connected to the connector and the manifold structure.

In use, the subsea well may be connected to a subsea pipeline at a connection station by guiding a drilling tool to a target location for a subsea well, and drilling the subsea well in the vicinity of (e.g., adjacent) the subsea pipeline. A wellhead support comprising a wellhead may be aligned with the drilled subsea borehole at a location adjacent to the subsea pipeline to provide a subsea well, and then a connection module may be mounted on the wellhead support and connected to the subsea pipeline at the connection station. Connecting the subsea well in this way may permit for more flexibility in the laying and positioning of the subsea pipeline, and the pipelay is not required to be completed in stages. In addition, no well jumpers are required to connect the well to the subsea pipeline, and therefore there is a reduced number of connection points and therefore risk of leakage to the outside environment. The connection points are also cheap to produce, and no measuring between the well and connection station is required in order to connect the well to the subsea pipeline, as the connection module may connect directly to the subsea pipeline at the connection station, and need not be installed as a separate unit and then separately connected to the subsea pipeline.

The method of connecting a subsea well to a subsea pipeline is illustrated in FIGS. 1 to 11.

In FIG. 1, there is illustrated a subsea pipeline 2 having a first end and a second end, configurable to be located subsea, and supported by a pipeline support 4. The pipeline support 4 may provide that the subsea pipeline 2 does not move significantly in a subsea location, and maintains the orientation with which it was installed. The subsea pipeline 2 may be a single or multi bore pipeline, or an integrated pipeline and umbilical (IPU), in which case multiple pipelines and/or conduits may be contained within the subsea pipeline 2. In this case, the pipeline support 4 is in the form of a mud mat, and the subsea pipeline 2 is supported by two pipeline supports 4 located on either side of a connection station 6 which is located in an intermediate position between the first and second ends of the pipeline 2. In this embodiment, the two pipeline supports 4 are longitudinally offset from the connection station 6.

The connection station 6 comprises a connector for connecting a fluid conduit thereto and at least one fluid port, and may also be considered to comprise a section of the subsea pipeline 2, for example, the section of subsea pipeline 2 located between the two pipeline supports, or the section of subsea pipeline 2 located between guide members of a guiding arrangement, as will be described. The method may therefore comprise installing a pipeline support 4 under the subsea pipeline 2. The method may comprise installing a pipeline support 4 at a location longitudinally offset from the connection station 6 on the pipeline. The connection station 6 comprises a branch 8 that extends from the subsea pipeline 2 and in this example permits fluid communication between the subsea pipeline 2 and an external apparatus or device via a fluid port 5 located thereon, for example, an external apparatus or device such as a conduit, a section of pipeline or a jumper.

The branch may be in the form of a tee, such as an inline tee. The branch 8 here extends at right angles to the subsea pipeline 2, although it should be appreciated that in other examples, the branch 8 may extend at a different angle relative to the subsea pipeline 2, such as an oblique angle, for example, at 30 degrees, 45 degrees or 60 degrees. The orientation of the branch relative to the subsea pipeline 2 may be dependent on the orientation of the subsea pipeline 2 as located in the subsea location. For example, the branch 8 may extend vertically upwards from the subsea pipeline 2, which may be at 90 degrees to the subsea pipeline 2, or some other angle if the subsea pipeline 2 is, for example, located on an incline or uneven surface.

Located in the branch 8 in this example is a valve 10. The valve 10 may be any appropriate type of valve, for example, a ball valve, a butterfly valve or a gate valve. The valve 10 here functions to permit fluid communication between the subsea pipeline 2 and an external apparatus or device, for example, a conduit such as a section of pipeline or jumper. The valve 10 may be controlled by an actuator 14. The actuator 14 may be used to configure the valve 10 between an open and closed position, for example, via an ROV or a remote control, which may be located at a surface location. In some examples, there may be no valve 10 in the branch 8. In such cases, a valve 10 may instead be located in the subsea pipeline 2, for example.

The connection station 6 additionally comprises at least one connector 16 for connection to an external apparatus or device. The connector 16 may be located on the branch 8, for example, on an extremity of the branch 8. The connector 16 may be of any appropriate type, such as a stab-in connector, a threaded connector, or the like. In this example, the connector 16 surrounds the fluid port 5, which permits fluid communication with the subsea pipeline 2. In this example, the connection station 6 (e.g., the branch 8) comprises one connector 16, although may comprise a plurality of connectors 16 (e.g., two, three, four or more connectors) in examples where it is desirable to connect to more than one external apparatus or device. In some examples, there may be additional fluid ports and/or connection points to provide additional forms of communication with the subsea pipeline 2, such as electrical and/or hydraulic communication, and therefore the connection station 6 (e.g., the branch 8) may additionally comprise an electrical connection point and/or a hydraulic fluid port therein. In some examples, there may be more than one fluid port 5 to provide both production and injection fluid flow into an associated well, and therefore there may exist an injection and a production fluid port in fluid communication with an interior of the subsea pipeline 2. In this example, both the actuator 14 and connector 16 may be provided as part of the valve 10, and therefore by installing a different type or configuration of valve 10 on the branch 8, it may be possible to have any desired number of connectors 16 (e.g., two, three, four or more connectors) and associated valve 10 or valves (e.g., in examples where the valve 10 comprises a double valve arrangement per associated connector 16). In some other examples, no branch may exist, and the connector 16 (and an associated fluid port 5) may be located directly on the subsea pipeline 2.

Although not illustrated, the connector 16 and/or the fluid port 5 may comprise a cap or cover, which may be positioned on the connector 16 and/or the fluid port 5 when not in use. As such, the method may comprise installing a cap on the connector 16 and/or the fluid port 5 prior to positioning of the subsea pipeline 2 in a subsea location, and may comprise removing the cap prior to connection of the fluid port 2 and connector 16 to an external component or device, such as a connector module as will be further described in the following paragraphs.

In this example, a support platform 18 is positioned around the connector 16. The support platform may comprise an aperture therein, through which the connector 16 may be positioned. As illustrated, the support platform 18 may comprise one or a plurality of (e.g., two, three, four etc.) attachment points 20 used for connecting (e.g., rigidly connecting) an external apparatus or device to the connector 16, or relative to the connector 16. The attachment points 20 may assist to provide a secure connection between an externally connected apparatus or device, so that it is not easily moved or dislodged by forces from subsea currents, or by small external forces, such as an impact from an ROV. The attachment points 20 may be in the form of stab-in connectors, bolts or screws, apertures through which a tie or bolt may be threaded, or the like. The support platform 18 may act to support a component of the weight of an external apparatus or device that is connected to the connector 16, so that a load path is created through the valve 10 to the subsea pipeline 2.

The pipeline supports 4 (e.g., mud mats), on which the subsea pipeline 2 is supported, may be foldable or collapsible, such as in this example. Having a foldable or collapsible pipeline support 4 may assist the case of installation of the pipeline support 4 (e.g., if the pipeline support 4 is required to be overboarded and guided through a stinger, then a foldable pipeline support 4 may be more easily maneuvered). During installation, the pipeline support 4 (e.g., the mud mat) may have a folded configuration, and then may be reconfigured to an unfolded configuration once in a desired position (see FIG. 2).

In this example, the subsea pipeline 2 is additionally connected to a guiding arrangement 22, with the guiding arrangement 22 forming part of the connection station 6 in this example. The described method may comprise connecting the guiding arrangement 22 to the subsea pipeline 2. For example, the method may comprise connecting the guiding arrangement 22 to the subsea pipeline 2 via a connection member or plurality of connection members, such as ties or brackets. The method may comprise connecting the guiding arrangement 22 to the subsea pipeline 2 at a subsea location. The method may comprise connecting the guiding arrangement 22 to the subsea pipeline 2 after installation of the subsea pipeline 2 in a subsea location. The guiding arrangement 22 comprises a plurality of primary guide members 24, for example, guide rods, in this case, two primary guide members 24. The primary guide members 24 are attached to a guide base 26 positioned below the subsea pipeline 2, and the guide base 26 may sit on the seabed, for example. The guide base 26 may function to provide an attachment point, structure etc. for attachment between the guiding arrangement 22 and the subsea pipeline 2. The method may comprise connecting the guiding arrangement 22 to the subsea pipeline 2 at the guide base 26 of the guiding arrangement 22. Such an attachment configuration may improve the stability of the attachment between the guiding arrangement 22 and the subsea pipeline 2. The guide base 26 is in the form of a frame, and is connected (e.g., attached or mounted), in this example, via a plurality of ties to the subsea pipeline 2. The ties connect struts in the guide base 26 to the subsea pipeline 2, although the skilled reader will understand that the guide base 26 may take another form such as a plate, and any appropriate means may be used to connect (e.g., secure) the guiding arrangement 22 to the subsea pipeline 2. For example, where the guide base 26 is in the form of a plate, the subsea pipeline 2 may rest on top of the plate. In some examples, the guide base 26 may comprise further support members to hold the subsea pipeline 2 in place on the seabed, or relative to the guiding arrangement 22. The method may as such comprise positioning the guide base 26 of the guiding arrangement 22 under the subsea pipeline 2, and optionally connecting the subsea pipeline 2 to the guiding arrangement 22. The primary guide members 24 may extend at 90 degrees to the guide base 26. The primary guide members 24 may extend vertically upwards from the guide base 26, which may require the primary guide members 24 to extend at 90 degrees from the guide base 26, or another angle (e.g., an oblique angle relative to the guide base 26) in situations where the guide base 26 is positioned on an incline.

Figure 2:
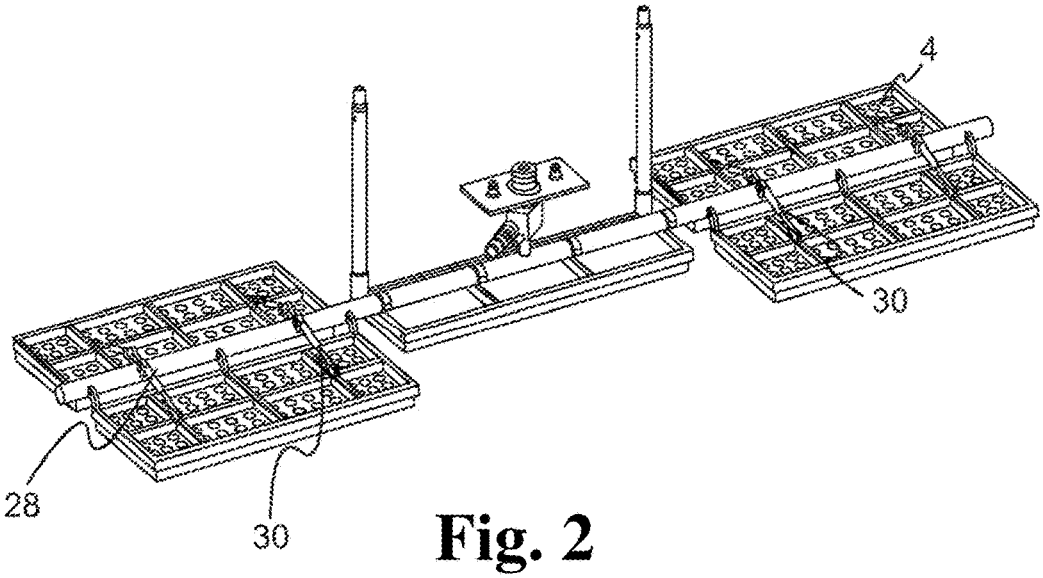
FIG. 2 shows the subsea pipeline and guiding arrangement of FIG. 1, with a pipeline supporting device having been reconfigured.

As previously described, the method comprises positioning (e.g., installing or securing) the subsea pipeline 2 in a subsea location, such as on the seabed or on (e.g., at least partially on) a subsea structure. As the subsea pipeline 2 is installed, the method may comprise the pipeline support 4 being in a compact configuration, such as being folded in the case of the illustrated mud mats. The method may comprise configuring the subsea pipeline 2 to an expanded configuration, such as an unfolded configuration in as illustrated in FIG. 2, which shows the mud mats having been unfolded, and lying flat against the seabed or subsea structure on which the subsea pipeline 2 is positioned. As can be seen in FIG. 2, the pipeline support 4 comprises a plurality of hinges 28, which permit the pipeline support 4 to be configured from a compact configuration to an expanded configuration. Alternatively, or additionally, the pipeline support 4 may comprise an extendable or telescopic portion to assist in the reconfiguration between the compact and expanded configurations. In the example of FIG. 2, the pipeline support 4 comprises a plurality of telescopic supports 30 (which may be the form of a telescopic arm, or a hydraulic piston), which assist to secure the pipeline support 4 in the expanded configuration and may, for example, lock the pipeline support 4 in the expanded configuration. The method may therefore comprise configuring the pipeline support or supports 4 from a compact to an expanded configuration, and optionally securing and/or locking the pipeline support 4 in the expanded configuration.

Figure 3:
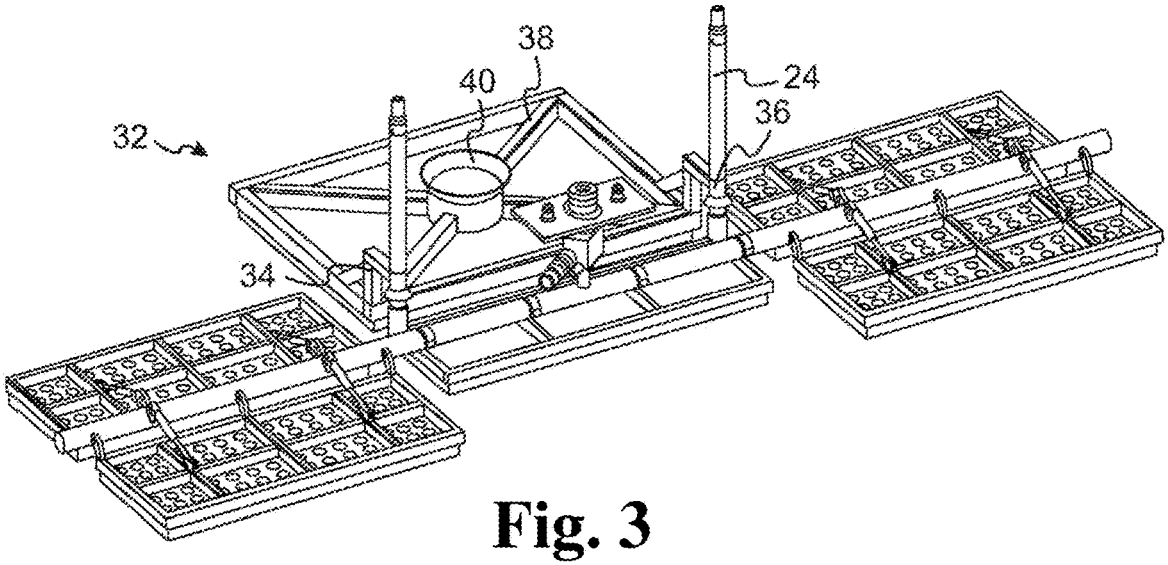
FIG. 3 shows the subsea pipeline and guiding arrangement with an adjacently located drilling guide.

Illustrated in FIG. 3, a drilling guide 32 is secured (e.g., temporarily secured) relative to the subsea pipeline 2 (e.g., secured to the connection station 6), and FIG. 3 illustrates the step of the installing (e.g., mounting or securing) a drilling guide 32 relative to the subsea pipeline. The drilling guide may be for establishing a well relative to (e.g., positioned relative to, adjacent to) the subsea pipeline 2. The drilling guide 32 may be a rigid structure. The method may comprise connecting (e.g., securing, mounting, installing, or the like) the drilling guide 32 to the connection station 6 of the subsea pipeline 2. In this example, the drilling guide 32 is mounted to the guiding arrangement 22 of the subsea pipeline 2 via the primary guide members 24. The method may comprise mounting the drilling guide 32 to the guiding arrangement 22 via the primary guide members 24. The method may comprise securing a drilling guide 32 to the subsea pipeline 2 (e.g., to the connection station 6 of the subsea pipeline 2). By connecting the drilling guide 32 to the subsea pipeline (e.g., the connection station 6 of the subsea pipeline), a user may be enabled to drill a subsea borehole in the vicinity of the subsea pipeline 2, at the connection station 6 thereof, thereby providing that a subsea borehole is provided adjacent the connection station 6.

The drilling guide 32 comprises a plurality of guide base engagement members 34 that engage the primary guide members 24, and which may correspond in number to the number of primary guide members 24, in this case, two. The drilling guide 32 may additionally abut the guide base 26 of the guiding arrangement 22 which may have the effect of assisting to secure the drilling guide 32 in place relative to the subsea pipeline 2. The method may comprise positioning the drilling guide 32 so as to abut the guiding arrangement 22, e.g., the guide base 26 of the guiding arrangement. The method may comprise engagement of a plurality of guide base engagement members 34 with a corresponding plurality of guide base engagement members 34, for example, so as to secure the drilling guide 32 relative to the guiding arrangement 22 and the subsea pipeline 2.

As illustrated in FIG. 3, the primary guide members 24 may comprise an upper section of reduced diameter, which may assist in the guiding of the drilling guide 32 onto the primary guide members 24 and guiding arrangement 22. The method may comprise guiding the drilling guide 32 onto the guiding arrangement 22, for example, via the plurality of primary guide members 24. The method may comprise connecting the drilling guide 32 to the connection station 6, for example, to the subsea pipeline 2 at the connection station 6, and/or to the guiding arrangement 22 of the connection station 6. The method may comprise connecting the drilling guide 32 to the subsea pipeline 2 via the guiding arrangement 22, and/or establishing a direct connection between the drilling guide 32 and the subsea pipeline 2. As illustrated, the guide base engagement members 34 may comprise a profiled section 36 for engaging the primary guide members 24, such as a looped or annular engagement portion, which may fit around the primary guide members 24 to engage the drilling guide 32 therewith. Once guided by the plurality of primary guide members 24, the drilling guide 32 may lie flat on a subsea surface, such as the seabed or at least partially on subsea infrastructure. The method may comprise positioning the drilling guide 32 flat on a subsea surface. The drilling guide may be in contact with the seabed.

The drilling guide 32 in this example comprises a frame (here, a rectangular frame), which is substantially flat or planar in shape. The frame may be a rigid frame. As illustrated in FIG. 3, the drilling guide 32 may comprise a plurality of support struts 38 which connect a drilling guide 40 to the outside of the frame of the drilling guide 32. The drilling guide 40 comprises a sleeve for guiding and/or positioning a drilling tool at a target location for a subsea borehole and/or subsea well. The drilling guide may therefore permit a drilling tool to be positioned within the frame of the drilling guide 32, and the method may comprise positioning a drilling tool within the frame of the drilling guide 32. The sleeve may be oriented so that, when the drilling guide 32 is mounted to the guiding arrangement 22, the sleeve is horizontally oriented in the subsea location, and extends with a central axis thereof in a substantially vertical orientation. In other examples, the central axis of the sleeve may be configured or configurable to extend in a substantially vertical direction when the drilling guide 32 has a different orientation other than horizontal in the subsea location, for example, when the drilling guide 32 is located on an inclined surface. The drilling guide 40 may additionally comprise a funnel portion located on an upper end thereof, which linearly increases the diameter of the upper part of the drilling guide 40, which may assist to guide a drill string into place in the drilling guide. The method may comprise drilling a subsea borehole by positioning a drilling tool in the sleeve, and e.g., moving the drilling tool through the sleeve to drill a subsea borehole. The method may comprise positioning a drilling tool and/or a drill string relative to the subsea pipeline 2, for example, guiding a drill string/drilling tool to a drilling location relative to the subsea pipeline 2 by using the drilling guide 32, for example, by using the drilling guide 40 and/or the primary guide members 24. The method may comprise drilling a subsea borehole adjacent (e.g., in the vicinity of) the subsea pipeline 2, for example, using the drilling guide 32, such as drilling a subsea borehole adjacent the subsea pipeline 2 through the sleeve of the drilling guide 32. The method may comprise drilling a subsea borehole at a target location for a subsea well. The method may comprise drilling a bore hole and/or a subsea well in a location that is laterally offset and adjacent to the subsea pipeline 2. The method may comprise drilling a subsea bore through the drilling guide 32, for example, with the drilling guide 32 being secured relative to the subsea pipeline 2. The method may comprise drilling a subsea borehole through the drilling guide 32, with the drilling guide 32 being directly connected to the guiding arrangement 22 and/or to the subsea pipeline 2. The borehole drilled through the drilling guide 32 may be a subsea well or may be subsequently formed into a subsea well. The method may comprise protecting the subsea pipeline 2 with a protector during drilling of the subsea borehole. The method may comprise covering the drilling guide (or a wellhead support, as will be described) and optionally the subsea pipeline 2 with a protection cover during drilling of the subsea borehole. The method may comprise protecting the subsea pipeline 2 at the connection station 6 during drilling of the subsea borehole. The method may comprise securing a drilling guide 32 relative to the subsea pipeline 2 having a protective cover installed thereon.

Figure 4:
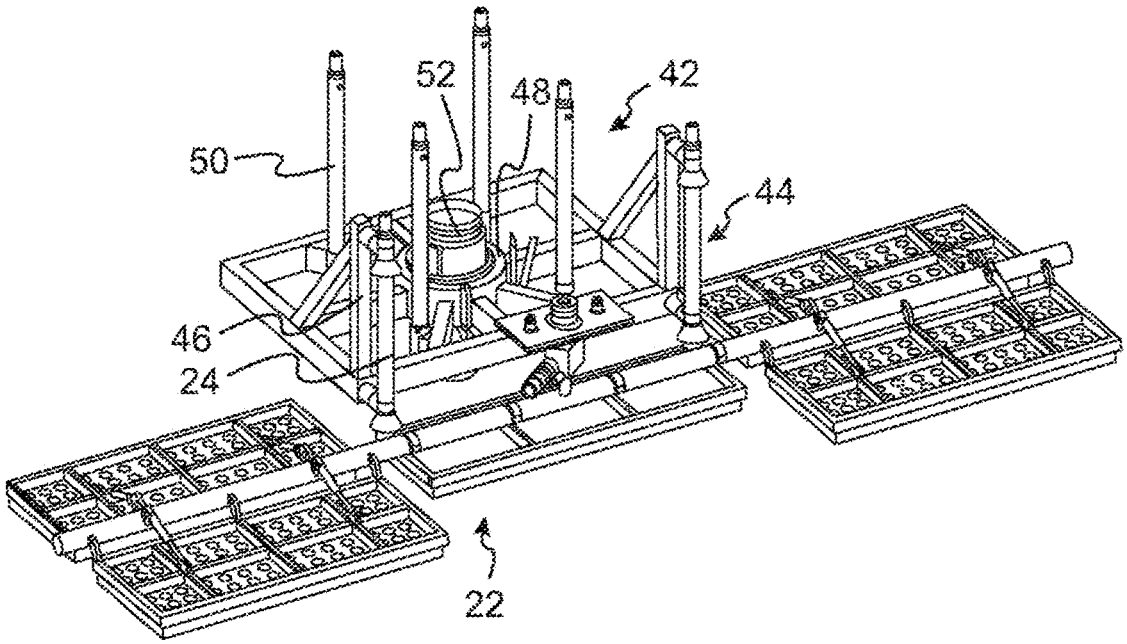
FIG. 4 shows the subsea pipeline and guiding arrangement with a wellhead support positioned adjacent thereto.

In FIG. 4, there is illustrated the subsea pipeline 2 with a wellhead support 42 installed relative thereto. The wellhead support 42 may be or comprise a permanent guide base. The wellhead support 42 may be a rigid structure. The wellhead support 42 may be connected to the connection station 6. The method may comprise connecting the wellhead support 42 to the subsea pipeline 2 at the connection station 6. The wellhead support 42 is here mounted on the guiding arrangement 22, which may form part of the connection station 6. The method may comprise connecting the wellhead support 42 to the subsea pipeline 2 via the guiding arrangement 22, and/or in some examples may comprise a direct connection between the wellhead support and the subsea pipeline 2. The wellhead support 42 may, as in this example, be mounted to the primary guide members 24 of the guiding arrangement 22. The method may therefore comprise securing (e.g., connecting, mounting, attaching or the like) the wellhead support 42 to the connection station 6, for example, the primary guide members 24 of the connection station 6. The wellhead support 42 may be positioned, installed etc. on top of the drilling guide 32. In some examples, the drilling guide 32 may form part of the wellhead support 42, for example, the wellhead support 42 may be installed upon the drilling guide 32 so as to incorporate the drilling guide 32 therein, or so as to be supported by the drilling guide 32, for example, on the seabed. The wellhead support 42 may comprise an engagement arrangement for engaging the drilling guide 32. In some examples, the method may comprise using the wellhead support 42 to guide and/or position a drilling tool at a target location for a subsea borehole or well. In such examples, having a separate drilling guide 32 may not be necessary, as the wellhead support 42 may provide all of the functions of the drilling guide as previously described.

In common with the previously described drilling guide 32, the wellhead support 42 comprises a frame (in this case, a rectangular frame, but the skilled reader will understand that any appropriate shape of frame may be acceptable, such as a triangular frame, pentagonal frame, circular frame, or the like). The wellhead support 42 may be for establishing a subsea well relative to (e.g., positioned relative to, adjacent to, etc.) the pipeline 2. The frame may be a rigid frame. The frame comprises a plurality of support struts that connect the periphery of the frame to a guide sleeve 48, which in this example is located in the center of the frame.

In some examples the guide sleeve 48 of the wellhead support 42 may be structurally similar to, and may provide all of the functions of, the sleeve of the drilling guide 40. The guide sleeve 48 may be used to guide and/or position a drilling tool at a target location for a subsea borehole or well. A drilling tool may be moved through the guide sleeve 48 to drill a subsea borehole. The wellhead support 42 additionally comprises a plurality of secondary guide members 50 (e.g., guide rods or shafts) which extend vertically upwardly from the wellhead support, for example, from the frame of the wellhead support 42 or from the guide sleeve 48. The secondary guide members 50 may be straight and/or elongate (e.g., straight along the entire length of the guide members 50).

The wellhead support 42 comprises an engagement arrangement 44 which may be used to engage the guiding arrangement 22. The method may comprise engaging the engagement arrangement 44 of the wellhead support 42 with the guiding arrangement 22 to secure the wellhead support 42 relative to the subsea pipeline 2. The method may comprise lowering the engagement arrangement 44 onto the guiding arrangement 22 to secure the wellhead support 42 relative to the subsea pipeline, e.g., lowering the engagement arrangement 44 onto the primary guide members 24 of the guiding arrangement 22. The engagement arrangement 44 may comprise a plurality of engagement members 46 configured to engage the primary guide members 24 of the guiding arrangement 22. In contrast to the guide base engagement members 34 of the drilling guide 32, in this example, there are illustrated four engagement members 46, two lower engagement members, and two upper engagement members. The lower engagement members are connected to the frame of the wellhead support 42, in this example, to the outer peripheral surface of the frame, in this example, at one point. When the wellhead support 42 is installed in its desired position (e.g., lying flat on the seabed or lying at least partially, or wholly, on a subsea structure) then the lower engagement members engage the primary guide members 24 at or towards the base thereof. The desired location of the wellhead support 42 may be on top of the borehole or subsea well, e.g., so that the guide sleeve 48 is aligned with the borehole or subsea well. The upper engagement members are attached to the frame of the wellhead support 42 at two points in this example. The upper engagement members are here illustrated as being attached to an upper peripheral surface of the frame. This configuration may permit the upper engagement members to be located further from the wellhead support 42 than the lower engagement members, while preventing buckling or deformation of the upper engagement members. The upper engagement members, as illustrated in FIG. 4, engage the primary guide members 24 at or towards the top thereof.

The wellhead support 42 may comprise a wellhead. The method may comprise mounting or installing the wellhead to the guide sleeve 48 of the wellhead support 42. The method may comprise positioning and/or aligning the wellhead with the subsea borehole to provide a subsea well. The method may comprise mounting or installing the wellhead within the frame of the wellhead support 42. As such, the wellhead support may permit a subsea well comprising a wellhead to be installed adjacent (e.g., in the vicinity of) a subsea pipeline 2, and in particular adjacent to the connection station 6 of the subsea pipeline 2.

The guide sleeve 48 of the wellhead support 42 may contain and/or surround part of a conductor 52, the conductor 52 extending into the borehole (not shown) and protruding above the top of the guide sleeve 48. The conductor 52 may assist to stabilize the borehole and may be guided in place by the wellhead support 42. In this example, the method may comprise mounting the wellhead support 42 onto the guiding arrangement 22 and, using the wellhead support 42 as a guide, guide the conductor 52 into a desired position (e.g., a desired position in the borehole). The method may comprise guiding a conductor through the guide sleeve 48 of the wellhead support 42 and into a borehole aligned therewith. In some examples, the secondary guide members 50 may be used to assist in guiding the conductor 52 into position. Alternatively, the method may comprise installing the conductor 52 and subsequently installing the wellhead support 42 thereon. In this example, the conductor 52 itself, as well as the primary guide members 24, may be used to assist to position and mount the wellhead support 42 onto the guiding arrangement 22.

In order to assist in guiding an object, such as a conductor 52, connection module, or a wellhead or subsea Christmas tree (as will be described), the secondary guide members 50 may be positioned adjacent the guide sleeve 48. For example, the secondary guide members 50 may be positioned around the periphery of the guide sleeve 48. The secondary guide members 50 may be positioned in an angularly symmetrical configuration around the guide sleeve 48, as is illustrated in FIG. 4. In FIG. 4, there are four secondary guide members 50 (although the skilled reader will understand that there may be more or fewer secondary guide members 50, for example, two, three, five, six, or the like). In the example of FIG. 4, the guide members are positioned in a square configuration (e.g., a square array) around the guide sleeve 48, with each secondary guide member 50 being offset by 90 degrees from the vertical axis of the guide sleeve 48, relative to each neighboring secondary guide member 50. It will be appreciated that the angle of offset of each secondary guide member 50 may vary depending on the number of secondary guide members 50. For example, where there are more than four secondary guide members, the angle of offset may be less than 90 degrees, whereas when there are fewer than four secondary guide members, the angle of offset may be greater than 90 degrees. The offset between each of the secondary guide members 50 may be identical, or may differ. For example, the secondary guide members 50 may have a rectangular configuration (e.g., positioned in a rectangular array), in which case the angle of offset between each pair of the secondary guide members 50 would vary. Equally the secondary guide members 50 may be positioned in a triangular, pentagonal or amorphous configuration, in which case the angle of offset from the vertical axis of the guide sleeve 48 of each secondary guide member 50 relative to the next may be the same, or may vary.

The installation of the wellhead support 42 relative to the subsea pipeline 2 may be by any appropriate method, for example, the wellhead support may be lowered from the surface onto the guiding arrangement 22, and/or may be lifted into a desired position through use of an ROV.

Figure 5:
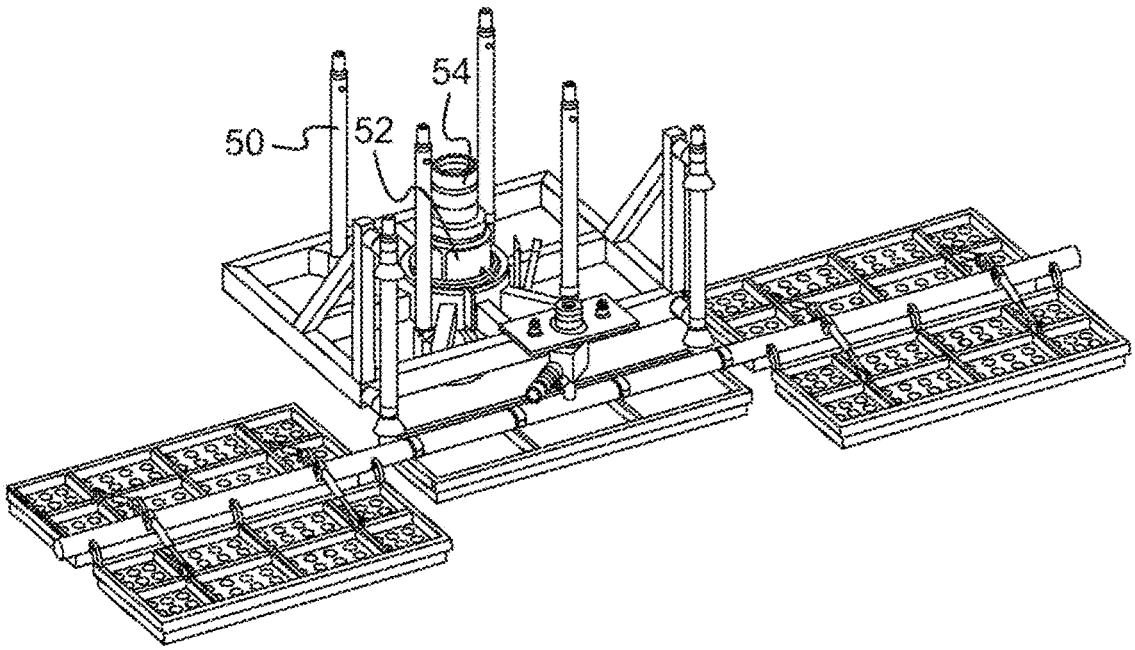
FIG. 5 shows a wellhead installed on a conductor located through the wellhead support.
Figure 6:
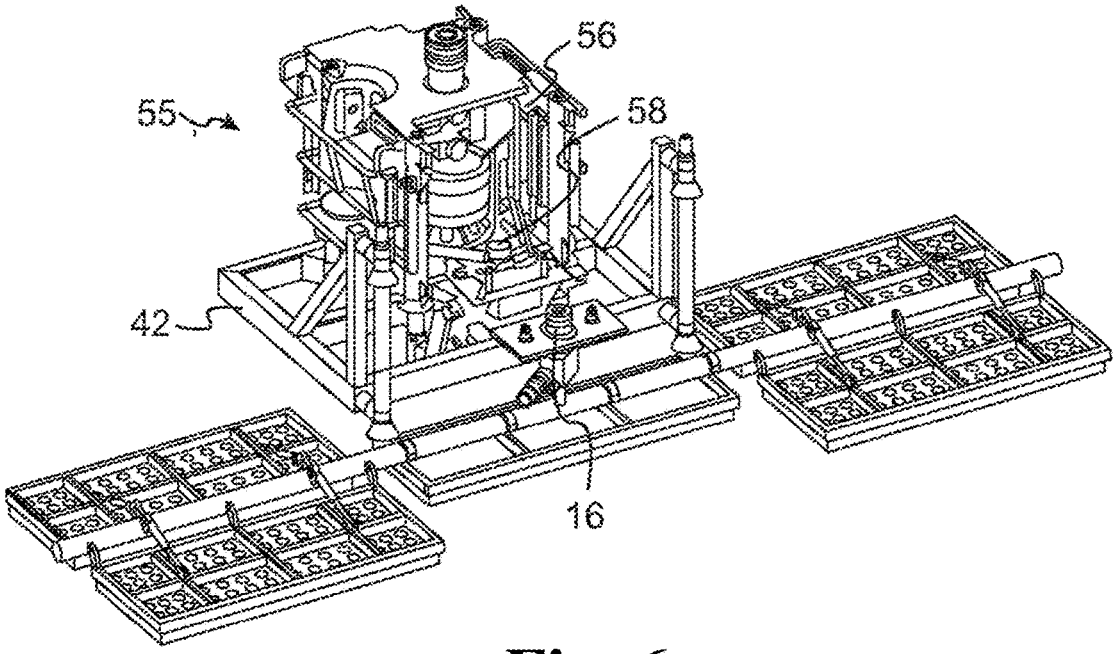
FIG. 6 shows a subsea Christmas tree installed on the wellhead support.

FIG. 5 illustrates a wellhead 54 being installed relative to the subsea pipeline 2, and onto the conductor 52. The method may therefore comprise installing the wellhead 54 on the conductor 52. The method may comprise installing further components, such as a wellhead 54 and associated completion. Either the wellhead 54 or the conductor 52 may be installed with a well bay insert (WBI), which may be used as an interface between the subsea well and a further component installed thereon (e.g., a connection module, as will be described). The method may comprise installing a wellhead 54 onto the wellhead support 42. Installing the wellhead 54 relative to the subsea pipeline 2 may involve mounting and/or securing the wellhead 54 to the conductor and/or the wellhead support 42. Installation of the wellhead 54 onto the conductor 52 and/or the wellhead support may be assisted by the secondary guide members 50, which may assist (e.g., an ROV) to locate the wellhead relative to the conductor 52. The guide sleeve 48 of the wellhead support 42 may surround the wellhead 54, and/or may provide structural support to the wellhead 54.

Once the wellhead 54 has been installed, a connection module 55 may be mounted thereon (see FIG. 6) to connect the wellhead 54 to the connection station 6 and to provide a conduit for flow of fluid between the borehole and the pipeline 2 via the flow port 5. The connection module 55 may provide a rigid connection between the wellhead 54 and the pipeline 2.

The connection module 55 may be or comprise a conduit which may optionally comprise a valve, a plurality of conduits (e.g., a production conduit and a hydraulic conduit), a length or length of cabling such as electrical and/or fiber optic cabling, a manifold structure, a choke bridge module etc. In the case where the connection module 55 is a choke bridge module, the connection between the choke bridge module and the subsea well may be such that the impact of tolerances on the connection is reduced, as the choke bridge module may be designed to fit to the subsea well based on its subsea positioning. The connection module 55 may be or comprise a single section of rigid conduit, for example, a rigid pipe or tubing section. The connection module 55 may be or comprise a subsea Christmas tree, and in the example illustrated in FIGS. 6 and 7, the connection module comprises a vertical subsea Christmas tree. Other types, such as a horizontal Christmas tree, may be equally suitable.

The method may comprise mounting, installing, connecting, or the like, the connection module 55 onto the wellhead 54 or the wellhead support 42. The method may comprise mounting, installing, connecting, or the like, the connection module 55 such that it is held above (e.g., entirely held above) the seabed and/or held above the level of the wellhead. The connection module 55 may extend within (only within the bounds of) the connection station 6 and the wellhead support 42, and as such the method may comprise mounting, installing, connecting or the like the connection module within (e.g., only within the bounds of) the connection station 6 and the wellhead support 42. Being within the bounds of the connection station 6 and the wellhead support 42 may mean that the connection module 55 is contained completely within the space above the connection station 6 and wellhead support 42. The entire length of the connection module 55 may be supported by at least one of the connection station 6 and the wellhead support 42, e.g., such that the connection module is held above the connection station (e.g., the subsea pipeline 2 or fluid port 5 thereof) and the wellhead support 42. As with the wellhead 54, the secondary guide members 50 may assist to locate the connection module 55 (e.g., a subsea Christmas tree 56) relative to the subsea pipeline 2. Although not illustrated, the connection module 55 may comprise a surface or profile, or a plurality of surfaces or profiles, that abut or rest upon or against the wellhead support 42, so as to support all or part of the weight of the connection module 55. For example, an abutting surface or profile of the connection module 55 may rest on the periphery of the frame of the wellhead support 42, or one of the support struts thereof 42. As such, having a wellhead support 42 that has a frame shape may assist to distribute the weight of the connection module 55, thereby stabilizing the connection module 55 subsea.

The connection module 55 may be a single component or it may comprise a first component which is installed on the wellhead support 42 or wellhead 54, and a second component (such as a rigid pipe or tube) which completes the connection to the subsea pipeline 2 via the connection station 6. The two components may be installed together in a single step, or separately, one after the other.

Figure 7:
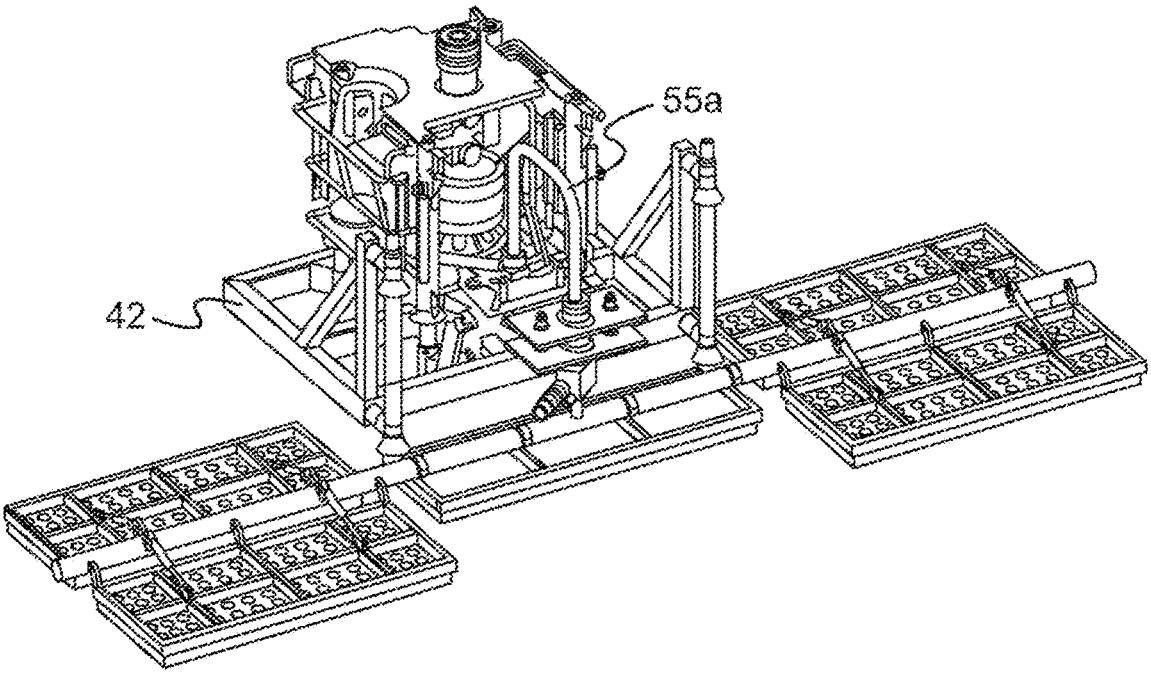
FIG. 7 shows the Christmas tree of FIG. 6 being fluidly connected to the subsea pipeline.

For example, where the connection module 55 comprises a subsea Christmas tree 56, the subsea Christmas tree 56 may be connected directly to the fluid port 5 of the connection station 6, or the connection module 55 may further comprise a connection conduit 55*a* for connecting the subsea Christmas tree 56 to the connection station 6 (e.g., the fluid port 5), as is illustrated in FIG. 7. In such an example, the subsea Christmas tree 56 may be installed in a first step, and then the connection conduit 55*a* may be installed subsequently. In other examples, the subsea Christmas tree 56 and the connection conduit 55*a* may be installed in a single step, and in some examples the connection conduit may be integrated within the subsea Christmas tree 56, and as such may not need to be installed separately.

In some examples, the connection conduit 55*a* may be considered to be the connection module 55. The connection conduit 55*a* may comprise a valve therein. The connection module 55 may connect to the subsea well via a secondary component mounted on the wellhead support 42. The secondary connection component may be the subsea Christmas tree 56, a manifold, a valve arrangement or any combination of the aforementioned. The method may comprise installing the secondary component onto the wellhead support 42. The method may comprise connecting (e.g., directly connecting) the connection module 55 to the connection station 6 and the secondary component. The method may comprise connecting (e.g., fluidly connecting) the connection module to a subsea well via the secondary component.

The relatively small size of the connection module 55 may permit the connection module 55 to be positioned as a single piece. The method may comprise locating and mounting, installing, connecting or the like, the connection module 55 to the connection station and/or a subsea well as a single piece. Locating, mounting, installing, connecting or the like, of the connection module 55 may therefore be achieved using a single tool, e.g., a single ROV. The connection module 55 may be used to connect a subsea well to the subsea pipeline 2 at the connection station 6 in a single operation. The method may comprise simultaneously connecting the connection module 55 to both the connection station 6 (e.g., the connector 16 of the connection station 6) and to a subsea well (e.g., a wellhead of a subsea well). The method may comprise connecting the connection module 55 to the connection station 6 in a single operation. The method may comprise positioning, lowering etc. the connection module 55 onto the wellhead support 42 so as to align the connection module 55 with the port 5 of the connection station 6, and simultaneously with a fluid connection (e.g., a wellhead fluid port) to the wellhead in the wellhead support 42.

The connection module 55 may comprise a module connector 58 which may permit fluid communication to and from the connection module 55. In this example, the module connector 58 is positioned to be adjacent to the subsea pipeline 2, and in particular to the connector 16 of the connection station 6 for permitting fluid communication to and from the subsea pipeline 2. Both the module connector 58 and the connector 16 of the connection station 6 are here positioned so that the central axis of the outlet is vertically oriented, which may assist to position and hold a device or apparatus (e.g., a pipeline, flowline or jumper) thereon, for example, by permitting case of access via an ROV and allowing the weight of a connected apparatus or device to act towards the relevant connector 16, 58. The module connector 58 may be any appropriate connector, and may be selected based on the connector 16 of the connection station 6. For example, the module connector 58 may be of the same type as that of the connector 16, such as a threaded connector or a stab-in connector.

With the connection module 55 positioned on the wellhead support 42, the connector 16 of the subsea pipeline 2 may be fluidly connected to the module connector 58. The method may comprise configuring the valve 10 so that fluid communication via fluid port 5 is prevented until the connector 16 has been fluidly connected to the connection module 55, thereby fluidly connecting the fluid port 5 with a fluid port of the connection module 55. Once the fluid port 5 of the connection station 6 is in fluid communication with a fluid port on the connection module 55, the valve 10 may be configured to the open position, in which fluid communication between the subsea pipeline 2 and the connection module 55 is possible.

The connection module 55 may additionally comprise a wellhead fluid connection (not illustrated) in the form of at least one fluid port that is able to be connected with the wellhead so as to permit fluid communication between the subsea well and the connection module 55. By fluidly connecting the subsea pipeline 2 to the connection module 55, as well as the subsea well to the connection module 55, a fluid connection between the subsea pipeline 2 and the subsea well may be established via the connection module 55. The method may therefore comprise fluidly connecting the connection module 55 to both a subsea well (e.g., the wellhead of a subsea well) and the subsea pipeline 2, actuating a wellhead valve in the wellhead of the subsea well to permit fluid communication between the subsea well and the connection module 55 and actuating the valve 10 in the connection station 6 of the subsea pipeline 2 to permit fluid communication between the connection module 55 and the subsea pipeline 2. The method may comprise first actuating the wellhead valve, and subsequently actuating the valve 10 in the connection module 55, or may comprise first actuating the valve in the connection module 55, and subsequently actuating the wellhead valve.

Once the connection module 55 is fluidly connected to the subsea pipeline, hydrocarbon production from the connection module 55 to the subsea pipeline 2 may commence. As the drilled borehole and subsea well is located adjacent the subsea pipeline 2, there is no requirement for installation of further large sections of subsea piping, thus making the subsea well cheaper and quicker to establish.

Figure 8:
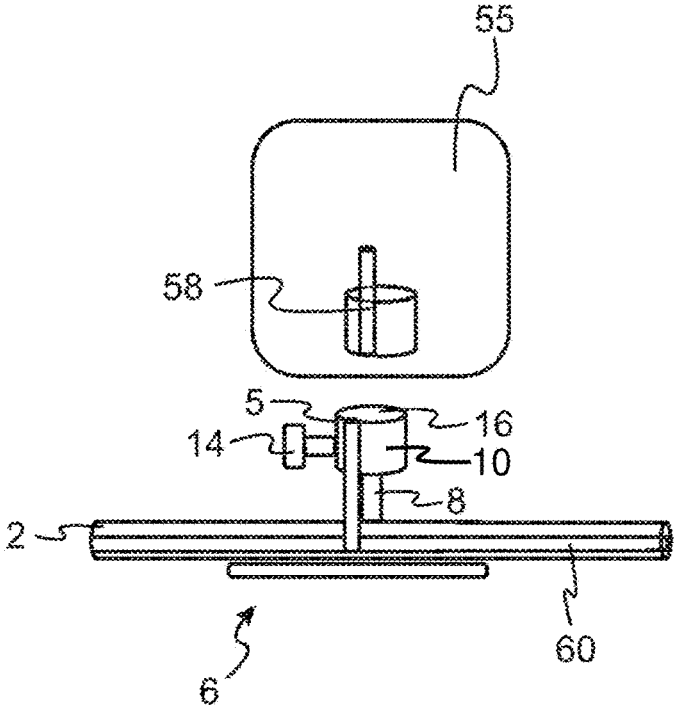
FIG. 8 shows a schematic of a first example of a subsea pipeline and connection module.
Figure 9:
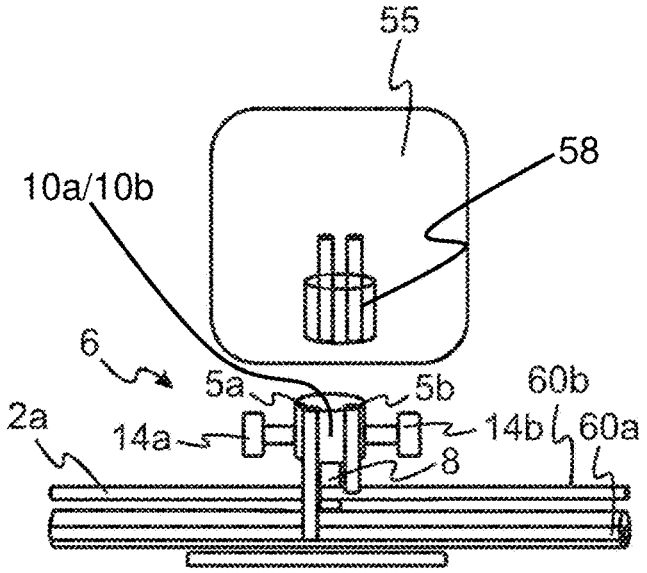
FIG. 9 shows a schematic of a second example of a subsea pipeline and connection module.

In FIGS. 8 and 9, there is schematically illustrated two examples of a connection station 6 and a connection module 55. For clarity, some features such as the guiding arrangement 22 have been omitted from these drawings. In FIG. 8, there is illustrated a connection station 6 and connection module 55 substantially as has been previously described. This includes a branch 8, a subsea pipeline 2, a fluid port 5, a valve 10, and an actuator 14. As previously described, the valve 10 can be used to permit or prevent/restrict flow through the fluid port 5, and the method may comprise actuating the valve 10 to an open position after connection with the connection module 55. The connection module 55 comprises a module connector 58 which may connect to the connection station 6 (e.g., the branch 8 and/or the connector 16 of the connection station) to provide a fluid connection between the connection module 55 and the subsea pipeline 2. Here, both the module connector 58 and the connector 16 of the connection station 6 comprise a single fluid port therein, and as such, one flow path 60 is established between the connection module 55 and the subsea pipeline 2. The flow path 60 may extend through the subsea pipeline 2 and be contained by the subsea pipeline 2 itself, or may be contained within a conduit within the subsea pipeline 2. In such examples, the subsea pipeline 2 may additionally be able to hold further (e.g., a plurality of) conduits and optionally at least one, or a plurality of, cables.

In FIG. 9, there is illustrated an example of a connection module 55 comprising a module connector 58 comprising a plurality of fluid ports therein (here, a first fluid port and a second fluid port). Equally, the connection station 6 comprises a plurality of fluid ports, in this example located in a branch 8 thereof. The first fluid port 5*a* provides fluid communication between the subsea pipeline 2 and the connection module 55 (for example, to permit flow of a produced hydrocarbon, injection fluid, or the like). As illustrated, in this example, the second fluid port 5*b* provides fluid communication between the connection module 55 and a secondary conduit 2*a*, e.g., an auxiliary pipeline. The secondary conduit 2*a* may be a pipeline, section of tubing, jumper or the like. The secondary conduit 2*a* may permit a flow of a fluid such as an injection fluid, hydraulic fluid, or the like, or may hold cabling, such as electrical or fiber-optic cabling. In cases where the secondary conduit 2*a* houses cabling, the second fluid port 5*b* may instead be in the form of a connection point, for example, connection to electrical and/or hydraulic cabling inside the secondary conduit 2*a*. The method may therefore comprise establishing a fluid connection between the subsea pipeline 2, and establishing a connection between the secondary conduit 2*a*, and the connection module 55. The established connection between the secondary conduit 2*a* and the connection module 55 may be a fluid connection, or may be an electrical and/or fiber-optic connection. The method may comprise aligning a first fluid port of the connection station 6 (e.g., located on the branch 8) with a first fluid port 5*a* of the connection module 55, and optionally aligning a second fluid port 5*b* or connection point 5*b* of the connection station 6 with a second fluid port or connection point of the module connector 55. Where the connection station 55 comprises a second fluid port 5*b*, a first flow path 60*a* and a second flow path 60*b* may be established to the connection module 55 (e.g., between the connection module 55 and the subsea pipeline 2, and optionally a secondary conduit 2*a*). The connection station 6 (for example, the branch 8 of the connection station 6) here comprises a first valve 10*a* and a second valve 10*a*, the first valve 10*a* having an associated first actuator 14*b* and the second valve 10*b* having an associated second actuator 14*b*, the first valve 10*a* and the second valve 10*b* being operable to permit or prevent a fluid communication between the first and second fluid ports 5*a*, 5*b* respectively. As such, fluid flow through the first and second fluid ports 5*a*, 5*b* may be independently controlled.

Although illustrated as being external to the subsea conduit 2 in FIG. 9, the secondary conduit 2*a* may be located within the subsea conduit 2.

While an example has been provided showing the connection station 6 having both one and two fluid ports, in other examples a greater number of fluid ports may be present, for example, three, four or more fluid ports.

Figure 10:
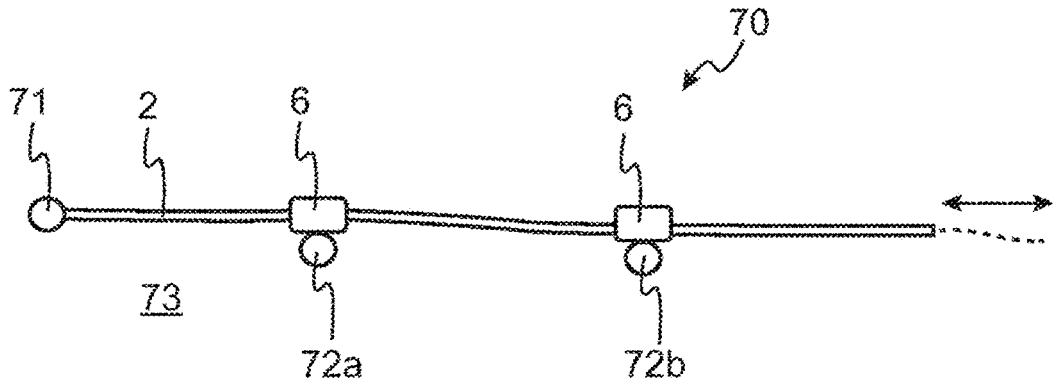
FIG. 10 shows a schematic illustration of a first embodiment of clusters of subsea wells connected via a subsea pipeline.
Figure 11:
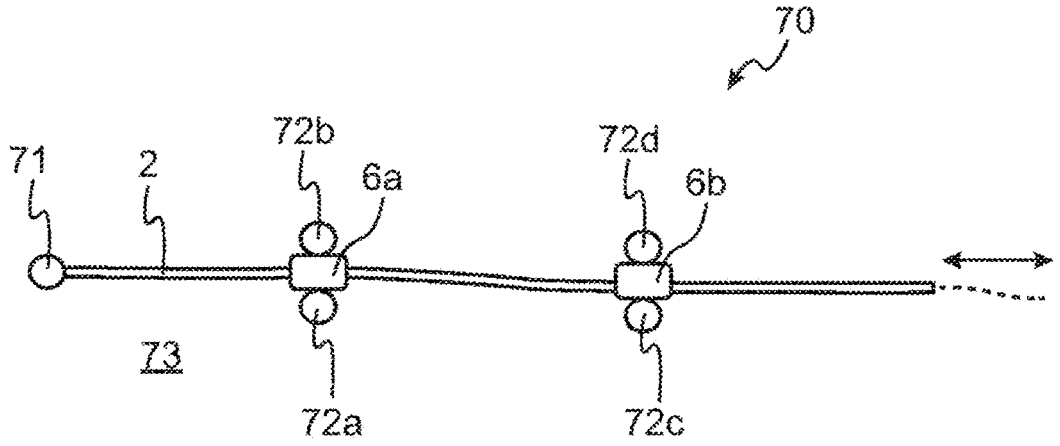
FIG. 11 shows a schematic illustration of a second embodiment of clusters of subsea wells connected via a subsea pipeline.

FIG. 10 illustrates a cluster 70 of subsea wells 71, 72*a*, 72*b* which comprises a first subsea well 71 from which extends a subsea pipeline 2. The pipeline 2 is installed on the sea floor 73, and an end of the pipeline 2 is fluidly connected to the first subsea well 71 using a connection apparatus such as a Christmas tree, so that fluid produced from the first subsea well 71 can flow into and along the subsea pipeline 2. An opposite end (not shown) of the subsea pipeline 2 may extend to and be connected to a production facility. The subsea pipeline 2 is also provided with at least one connection station 6*a*/6*b* which is spaced from the end of the subsea pipeline 2 and which comprises a fluid port and a connector for connecting a fluid conduit to the subsea pipeline 2 so that fluid can flow between the fluid conduit and the interior of the subsea pipeline 2 via the fluid port 5.

The cluster 70 additional comprises a second subsea well 72*a* which is fluidly connected to the subsea pipeline 2 via the or one of the connection stations 6*a*, 6*b*.

In the embodiment illustrated in FIG. 10, two such connection stations 6*a*, 6*b* are provided, the first connection station 6*a* being fluidly connected to the second subsea well 72*a*, and the second connection station 6*b* being fluidly connected to a third subsea well 72*b*. It will be appreciated that additional the cluster 70 could include further subsea wells which are each fluidly connected to the subsea pipeline 2 via a further connection station.

As mentioned above, each connection station 6 may comprise a plurality of connectors 16 (e.g., two, three, four or more connectors) so as to connect to more than one external apparatus or device to the subsea pipeline 2. This is the case in the embodiment illustrated in FIG. 11, and this shows the first and second subsea wells 72*a*, 72*b* are located directly adjacent to the subsea pipeline 2 at the first connection station 6*a*, and are fluidly connected to the interior of the subsea pipeline 2 via two separate connectors and flow ports in the first connection station 6*a*. Third and fourth subsea wells 72*b*, 72*c* are located directly adjacent to the pipeline 2 at the second connection station 6*b*, and are fluidly connected to the interior of the pipeline via two separate connectors and flow ports of the second connection station 6*a*.

The pipeline 2 and connection stations 6*a*, 6*b* may be as described above in relation to FIGS. 1 to 9, and the second and third subsea wells 72*a*, 72*b* may be installed and fluidly connected to the subsea pipeline 2 as described above in relation to FIGS. 1 to 9.

One or both of the second and third subsea wells 72*a*, 72*b* (and any further subsea wells) may be established after the pipeline 2 is installed and connected to the first subsea well 71. As such, fluid may be produced from the first subsea well 71 and flowed along the subsea pipeline 2 before one or both of the second and third subsea wells 72*a*, 72*b* are established. In this case, the fluid port of each connection station

6*a*, 6*b* may be closed using a cover or cap whilst this occurs. This flow of fluid from the first subsea well 71 along the subsea pipeline 2 may occur while one or both of the second and third subsea wells 72*a*, 7*b* are established. Once the second and/or third subsea well 72*a*, 72*b* is established, the cover or cap could be removed to facilitate the connection of the second/third subsea well 72*a*, 72*b* to the subsea pipeline 2.

It is possible that one or both of the second or third subsea wells 72*a*, 72*b* (or any further subsea wells) could be established a significant time after the installation of the subsea pipeline 2 on the sea floor 73. For example, there could be a delay of more than one year, more than two years or more than three years between installing the subsea pipeline 2 and establishing one or both of the second and third (or any other) subsea wells 72*a*, 72*b*. As such, more and more subsea wells could be added to the cluster 70, years after the use of the subsea pipeline 2 has commenced. The second, third and any further subsea wells 72*a*, 72*b* could be added singly, at separate times, all at once, or in different groups, or in a combination of groups and single well additions.

The person skilled in the art will realize that the present disclosure is not limited to the embodiments described above. The person skilled in the art further realizes that modifications and variations are possible within the scope of the appended claims. Additionally, variations to the disclosed embodiments can be understood and effected by the skilled person in practicing the claimed disclosure, from a study of the drawings, the disclosure, and the appended claims.

The present invention is not limited to embodiments described herein; reference should be had to the appended claims.

LIST OF REFERENCE NUMERALS

2 Subsea pipeline
2*a* Secondary conduit/Auxiliary pipeline
4 Pipeline support
5 Fluid port
5*a* First fluid port
5*b* Second fluid port/Connection point
6 Connection station
6*a* First connection station
6*b* Second connection station
8 Branch
10 Valve
10*a* First valve
10*b* Second valve
14 Actuator
14*a* First actuator
14*b* Second actuator
16 Connector
18 Support platform
20 Attachment point
22 Guiding arrangement
24 Primary guide member
26 Guide base
28 Hinges
30 Telescopic supports
32 Drilling guide
34 Guide base engagement members
36 Profiled section
38 Support strut
40 Drilling guide
42 Wellhead support
44 Engagement arrangement
46 Engagement member
48 Guide sleeve
50 Secondary guide members
52 Conductor
54 Wellhead
55 Connection module
55*a* Connection conduit
56 Subsea Christmas tree
58 Module connector
60 Flow path
60*a* First flow path
60*b* Second flow path
70 Cluster (of subsea wells)
71 First subsea well
72*a* Second subsea well
72*b* Third subsea well
72*c* Fourth subsea well
72*d* Fifth subsea well
73 Sea floor

What is claimed is:

1. A method for connecting a subsea well to a subsea pipeline, the method comprising:

providing a subsea pipeline comprising at least one connection station, the at least one connection station comprising a connector for connecting a fluid conduit to the connector, and at least one fluid port in a fluid communication with an interior of the subsea pipeline;

drilling a borehole adjacent to the at least one connection station;

locating a wellhead support adjacent to the at least one connection station;

connecting a guiding arrangement to the subsea pipeline, wherein the guiding arrangement comprises first and second guides disposed on opposite first and second sides of the at least one connecting station, and the first and second guides extend in an upward direction relative to the at least one connecting station;

connecting the wellhead support to the subsea pipeline;

mounting a wellhead on the wellhead support;

aligning the wellhead with the borehole to establish a subsea well;

mounting a connection module on the wellhead support or on the wellhead; and fluidly connecting the subsea well to the at least one fluid port in the at least one connection station via the connection module.

2. The method as recited in claim 1, further comprising:

locating a drilling guide adjacent to the at least one connection station;

guiding a drilling tool to a subsea well target location via the drilling guide; and drilling the borehole at the subsea well target location with the drilling tool.

3. The method as recited in claim 1, further comprising:

locating a conductor pipe in the borehole; and positioning the conductor pipe within a guide sleeve of the wellhead support prior to mounting the wellhead on the wellhead support.

4. The method as recited in claim 1, further comprising:

locating a section of the subsea pipeline between the first guide and the second guide, wherein the first and second guides comprise respective first and second guide rods, and the upward direction is substantially vertical.

5. The method as recited in claim 1, further comprising:

guiding the wellhead support to a location which is adjacent to the subsea pipeline via the first and second guides of the guiding arrangement.

6. The method as recited in claim 5, comprising a plurality of guides extending upwardly from the wellhead support.

7. The method as recited in claim 1, further comprising:

guiding a drilling guide to a location which is adjacent to the subsea pipeline via the first and second guides of the guiding arrangement; and drilling the borehole through a through-bore in the drilling guide, wherein, the through-bore is laterally offset from a longitudinal axis of the subsea pipeline.

8. The method as recited in claim 1, further comprising:

drilling the borehole through a guide sleeve in the wellhead support.

9. The method as recited in claim 1, wherein, the at least one connection station further comprises a valve for controlling a fluid flow between the subsea pipeline and the at least one fluid port, and the method further comprises:

operating the valve in the at least one connection station between a closed position in which the fluid flow between the subsea pipeline and the at least one fluid port is restricted, and an open position in which the fluid flow to the connection module via the at least one fluid port is permitted;

flowing a fluid in the subsea pipeline with the valve being in the closed position, and then;

fluidly connecting the subsea well to the at least one fluid port in the at least one connection station via the connection module.

10. A method comprising:

establishing a first subsea well;

installing, on a sea floor, a pipeline which is fluidly connected to the first subsea well, the pipeline comprising a connection station which comprises a connector for connecting a fluid conduit to the connector, and at least one fluid port in a fluid communication with an interior of the pipeline, wherein the connection station comprises first and second guides disposed on opposite first and second sides of the connection station, and the first and second guides extend in an upward direction relative to the connection station;

coupling a drilling guide to the connection station via the first and second guides; and coupling a wellhead support to the connection station via the first and second guides.

11. The method as recited in claim 10, further comprising:

establishing a second subsea well;

fluidly connecting the second subsea well to the pipeline via the connection station.

12. The method as recited in claim 11, wherein, the establishing of the second subsea well is performed after installing, on the sea floor, the pipeline, and a time between the installing, on the sea floor, of the pipeline and the establishing of the second subsea well exceeds one year.

13. The method as recited in claim 10, comprising switching between an installation of the drilling guide and the wellhead support coupled to the connection station via the first and second guides, wherein the wellhead support comprises a plurality of guides extending upward from the wellhead support.

14. A subsea pipeline system comprising:

a subsea pipeline having a first end and a second end;

at least one connection station which is arranged between the first end and the second end of the subsea pipeline, the at least one connection station comprising a guiding arrangement and a connector which is configured to connect a subsea well with an interior of the subsea pipeline; and a wellhead support coupled to the guiding arrangement via one or more primary guides, wherein the wellhead support comprises a plurality of secondary guides, and each of the plurality of secondary guides extends in an upward direction.

15. The subsea pipeline system as recited in claim 14, wherein the one or more primary guides of the guiding arrangement comprise a plurality of the primary guides configured to receive and to guide the wellhead support in place adjacent to the at least one connection station and the subsea pipeline.

16. The subsea pipeline system as recited in claim 15, wherein the guiding arrangement comprises a guide base coupled to the plurality of primary guides, the plurality of primary guides comprises a first vertically extending guide member and a second vertically extending guide member, the first vertically extending guide member is longitudinally offset from the second vertically extending guide member along the subsea pipeline, the first vertically extending guide member is located on a first side of a fluid port of the at least one connection station, the second vertically extending guide member is located on a second side of the fluid port, and the first side is longitudinally opposite to the second side.

17. The subsea pipeline system as recited in claim 14, further comprising:

a drilling guide which is connected the subsea pipeline, the drilling guide being configured to at least guide or position a drilling tool at a target location which is adjacent to the at least one connection station for drilling a subsea borehole or a well, wherein the drilling guide is coupled to the guiding arrangement via the one or more primary guides.

18. The subsea pipeline system of claim 14, wherein the plurality of secondary guide members comprises four secondary guides.

19. A subsea well system comprising:

a subsea pipeline comprising at least one connection station, wherein the at least one connection station comprises a connector for connecting a fluid conduit to the connector, at least one fluid port in a fluid communication with an interior of the subsea pipeline, and a guiding arrangement having one or more primary guides;

a drilled borehole adjacent to the at least one connection station;

a wellhead support adjacent to the at least one connection station, the wellhead support being connected to the subsea pipeline and the guiding arrangement via the one or more primary guides, wherein the wellhead support comprises a plurality of secondary guides, and each of the plurality of secondary guides extends in an upward direction;

a wellhead mounted on the wellhead support and aligned with the drilled borehole via the plurality of secondary guides;

a connection module mounted on the wellhead support or on the wellhead, the connection module fluidly connecting a subsea well to the at least one fluid port in the at least one connection station.

20. The subsea well system as recited in claim 19, wherein, the at least one connection station further comprises a valve for controlling a fluid flow between the subsea pipeline and the at least one fluid port, the valve being movable between a closed position in which the fluid flow between the subsea pipeline and the at least one fluid port is restricted, and an open position in which the fluid flow to the connection module via the at least one fluid port is permitted.

21. The subsea well system as recited in claim 19, wherein the connection module is connected directly to the at least one fluid port of the at least one connection station via the connector.

* * * * *